United States Patent [19]

Allasia

[11] 4,116,350

[45] Sep. 26, 1978

[54] GLASS JAR WITH THREAD PROTECTOR

[75] Inventor: Alberto Allasia, New York, N.Y.

[73] Assignee: Ferrero Nahrungs-und Genussmittel GmbH, Frankfurt am Main, Germany

[21] Appl. No.: 824,140

[22] Filed: Aug. 12, 1977

Related U.S. Application Data

[63] Continuation of Ser. No. 696,659, Jun. 16, 1976, abandoned.

[30] Foreign Application Priority Data

Jul. 3, 1975 [DE] Fed. Rep. of Germany ... 7521179[U]

[51] Int. Cl.[2] ..... B65D 1/02

[52] U.S. Cl. ..... 215/31; 215/1 R; D9/130

[58] Field of Search ..... 215/1 R, 31; D9/89, D9/90, 91, 119–131, 153, 86–88, 92–97

[56] References Cited

U.S. PATENT DOCUMENTS

| | | | |
|---|---|---|---|
| D. 86,565 | 3/1932 | Fuerst | D9/123 |
| D. 86,730 | 4/1932 | McDonald | D9/123 |
| D. 105,231 | 7/1937 | Petty | D9/153 |
| D. 111,226 | 9/1938 | Runnels | D9/123 |
| D. 120,804 | 5/1940 | Dunnock | D9/125 |
| D. 199,766 | 12/1964 | Lorenzen | D9/153 X |
| D. 241,319 | 9/1976 | Hefkey | D9/131 |
| 3,559,833 | 2/1971 | Alonso | 215/31 |

*Primary Examiner*—Donald F. Norton

*Attorney, Agent, or Firm*—Sughrue, Rothwell, Mion, Zinn and Macpeak

[57] ABSTRACT

Glass jars having side walls which in whole or in part do not extend outwardly beyond the periphery of the protruding thread ridges on the neck of the jar are provided with an outwardly extending bulge or ridge immediately below the neck of the bottle which will extend outwardly beyond the periphery of the thread ridges in those segments of the jar where the sides do not to protect the thread ridges prior to capping when a plurality of jars are disposed in contiguous relation to each other.

1 Claim, 5 Drawing Figures

GLASS JAR WITH THREAD PROTECTOR

This is a Continuation, of application Ser. No. 696,659, filed June 16, 1976, now abandoned.

BACKGROUND OF THE INVENTION

1. Field of the Invention

The present invention is directed to glass jars and more particularly glass jars having protective means to prevent chipping of the glass threads.

2. Prior Art

The use of all glass jars for food products is old and well known. Such jars usually have a neck section provided with thread ridges adapted to cooperate with a screw cap. Depending upon the shape of the body of the glass jar such thread ridges may protrude outwardly beyond at least a segment of the side walls of the glass jar.

If the neck section is provided with thread ridges which extend outwardly beyond the side walls of the glass jar difficulties in packaging arise from the fact that the thread ridges on adjacent jars can bump into each other while the glass jars are being transported on a conveyor belt, for instance leading to a filling machine, so that glass splinters might come off the jar. Should any of the glass splinters enter the jars and if it is impossible to remove the glass splinters before filling the jars the subsequent detection of chipped or broken threads on the neck of the jar will lead to a rejection of the jar thus causing substantial waste.

SUMMARY OF THE INVENTION

The present invention provides a glass jar which will reduce the susceptibility of such glass jars to splinter, especially in the vicinity of the glass thread ridges.

The present invention provides glass jars with bulges or ridges on those portions of the side walls of the body of the glass jar which do not extend outwardly beyond the periphery of the glass thread ridges. Such bulges are located immediately below the neck section of the jar having the glass thread ridges thereon and the bulges may be rounded off in correspondence with the extent of the glass thread ridges to present an attractive appearance. Since the glass thread ridges on the glass jars no longer protrude outwardly beyond the side walls of the body of the glass jar or the bulges the glass jars are splinter-proof to a much greater degree.

The present invention provides a glass jar having protective means for the glass thread ridges which enables the jars to be shipped side-by-side thereby eliminating the necessity for individual packaging of the glass jars thus providing a subtantial saving of packing material.

The present invention provides a glass jar having thread protection means comprising bulges or ridges on those portions of the side walls of the main body of the jar which do not extend outwardly beyond the periphery of the thread ridges on the neck of the jar. Preferably, the bulges are flush with the periphery of the thread but it is possible to have the bulges extend outwardly even further. The bulges can be used with glass jars having an irregular body configuration or can even be applied to round glass jars having a diameter inferior to as well as superior to the diameter of the thread ridges.

The foregoing and other objects, features and advantages of the invention will be apparent from the following more particular description of a preferred embodiment of the invention as illustrated in the accompanying drawings.

DETAILED DESCRIPTION OF THE PREFERRED EMBODIMENTS

Figure 2:
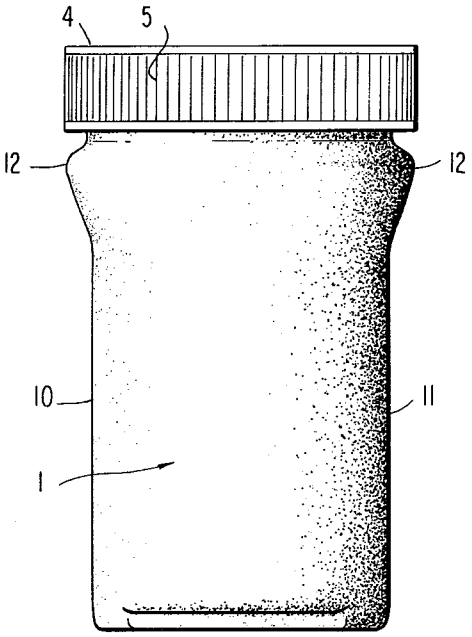
FIG. 2 is an end elevation view of the glass jar shown in FIG. 1 with a screw cap shown in solid lines.
Figure 1:
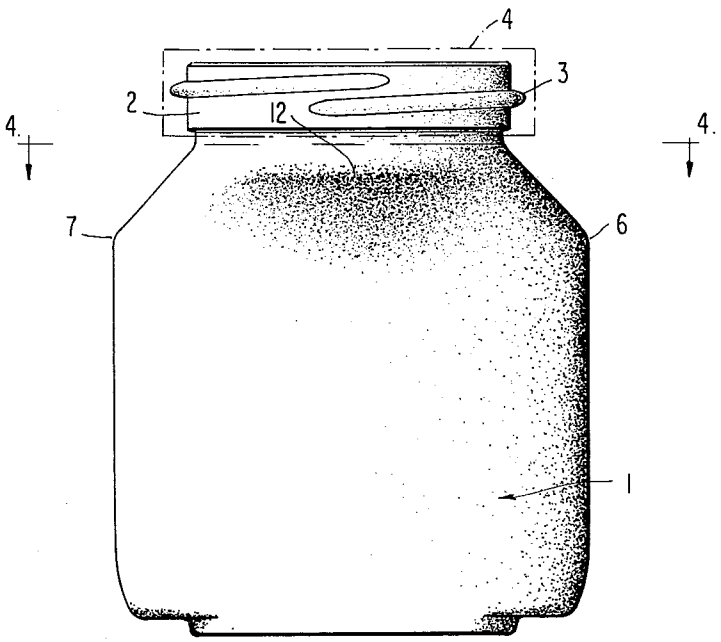
FIG. 1 is a side elevation view of a glass jar according to the present invention with the screw cap therefor shown in phantom lines.
Figure 4:
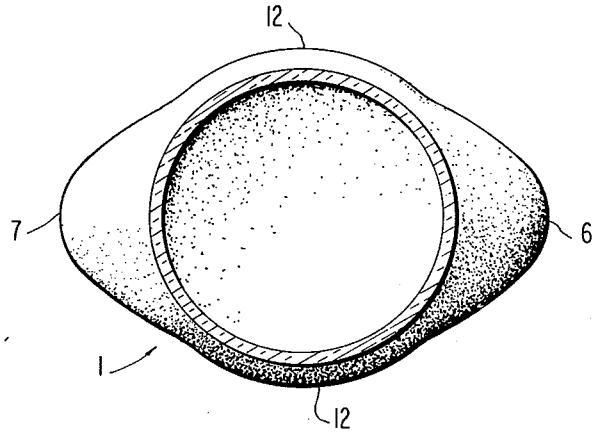
FIG. 4 is a transverse cross-section through the neck of the jar immediately above the bulges and looking down into the jar.
Figure 5:
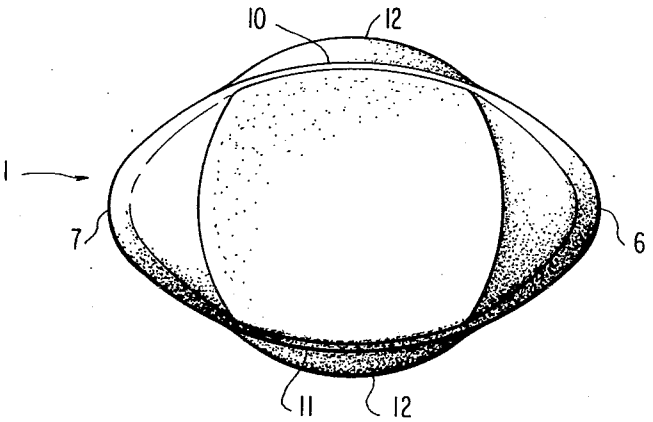
FIG. 5 is a bottom plan view of the glass jar.
Figure 3:
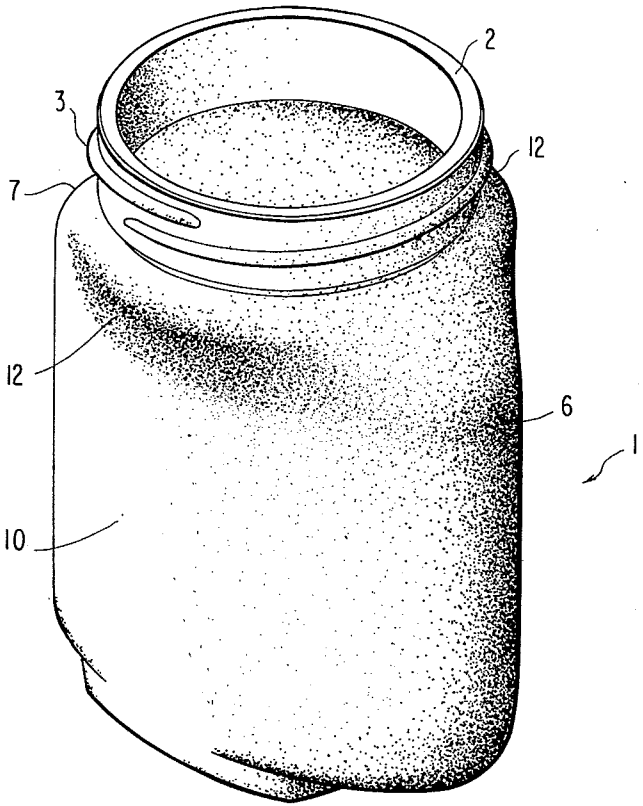
FIG. 3 is a perspective view of the glass jar shown in FIG. 1 without the screw cap.

The glass jar as illustrated in FIGS. 1 and 2 of the present application is representative of the type of jars used for food products such as jellies, honey, peanut butter or the like. The shape of the glass jar 1 is similar to a false ellipse so that the body of the jar is considerably narrower in one direction than in the other. The width of the long sides 10 and 11 of the jar as viewed in FIG. 1 is considerably greater than the outer diameter of the thread ridge 3 which is formed on the cylindrical neck 2 of the glass jar. The shorter sides 6 and 7 of the jar as viewed in FIG. 2 have a width less than the outer diameter of the thread ridge 3 on the cylindrical neck 2.

Prior to the closing of the jar by means of a screw cap 4 having a knurled surface 5 the glass jars are frequently disposed in such a manner that they can come into contact with one another as for instance during the conveying of the glass jars to a filling machine. It is obvious that if the sides 6 or 7 of one jar which extend outwardly beyond the periphery of the thread ridges 3 contact the sides 6 or 7 on another jar the threads 3 on each jar cannot possibly come in contact with each other and therefore are not susceptible to chipping or splintering.

In order to prevent the thread ridges 3 on adjacent jars from contacting each other should any other type of contact between the jars occur a pair of bulges or ridges 12, 12 are provided on the jar 1 immediately below the neck 2 which are coextensive in length with the sides 10 and 11. The bulges 12, 12 protrude outwardly a distance equal to or greater than the outer diameter of the periphery of the thread ridges 3 on the neck 2. The bulges 12 could of course be located further down on the body of the glass jar 1. The ends of the bulges 12, 12 may merge smoothly into the curvature of the narrow sides 6 and 7 of the jar to provide a pleasing appearance. Thus, should the sides 10 or 11 of one jar approach the sides 10 or 11 of an adjacent jar the bulges 12 will make contact to prevent the thread ridges 3 from contacting and possibly being chipped or splintered.

The possiblity of chipping and splintering the body of the glass jar, including the bulges, is substantially less than the possibility of chipping the thread ridges in the absence of the bulges due to the respective shapes and thicknesses. Even if the bulge 12 should be chipped or splintered the fact that the bulge is located considerably further away from the mouth of the jar than the thread ridges substantially reduces the possibility of the splinters or chips entering the jar.

While the invention has been particularly shown and described with reference to a preferred embodiment thereof it will be understood by those in the art that various changes in form and details may be made therein without departing from the spirit and scope of the invention.

What is claimed is:

1. In a glass jar of the type for receiving food products having a cylindrical neck section provided with thread ridges adapted to receive a screw cap thereon and a body section having side walls, at least a portion of which do not extend outwardly beyond the external periphery of said thread ridges with the remaining portions of the body of the glass jar extending outwardly a distance greater than the outer periphery of the thread ridges, the improvement comprising bulges located in the body section immediately below the neck section, said bulges being coextensive with the portions of the side walls of the body of the glass jar which do not extend outwardly beyond the periphery of the thread ridges and having a curved rounded off periphery corresponding to the course of the thread ridges which bulges extend outwardly a distance at least as great as the diameter of the neck portion through said thread ridges.

* * * * *